United States Patent [19]

Burns et al.

[11] 4,074,858

[45] Feb. 21, 1978

[54] HIGH PRESSURE PULSED WATER JET APPARATUS AND PROCESS

[75] Inventors: David J. Burns, Waterloo; Udo H. Mohaupt, Cambridge, both of Canada; Gene G. Yie, Chicago, Ill.

[73] Assignee: Institute of Gas Technology, Chicago, Ill.

[21] Appl. No.: 737,716

[22] Filed: Nov. 1, 1976

[51] Int. Cl.[2] ..... B05B 1/08

[52] U.S. Cl. ..... 239/172; 239/101; 299/17

[58] Field of Search ..... 239/101, 102, 172, 332; 299/17, 36

[56] References Cited

U.S. PATENT DOCUMENTS 3,796,371 3/1974 Taylor et al. ..... 239/101

3,857,516 12/1974 Taylor et al. ..... 239/101 X

*Primary Examiner*—Robert W. Saifer

*Attorney, Agent, or Firm*—Thomas W. Speckman

[57] ABSTRACT

A high pressure pulsed water jet apparatus and process operable in a vertical position especially suitable for automated pavement and rock fracture. The apparatus and process of this invention is used in combination with a thrust generator providing a substantially flat power stroke output thereby providing a pulsed water jet operating on the principle of pressure extrusion to generate repetitive water jet pulses of high velocity and at high repetitive frequency. The apparatus and process of this invention is especially suitable for providing an apparatus and process for fracturing pavement on a single self-contained vehicle which may be operated by a pre-programmed program means.

12 Claims, 6 Drawing Figures

HYDRAULIC FLUID
WATER
CONTROL CIRCUIT
WATER JET

WATER
WATER

HIGH PRESSURE PULSED WATER JET APPARATUS AND PROCESS

It is frequently desirable to fracture hard materials such as in mining and in demolition. Particularly, asphalt and concrete pavements require periodic maintenance and repair requiring removal of deteriorated areas. Also, especially in urban areas, many utility systems such as electric power lines, telephone cables, water and gas mains, sewers and other conduits are commonly installed under street pavements. Thus, when installing any utility systems or repairing existing utility systems, openings are frequently required through existing pavements.

Currently, asphalt and concrete pavements are fractured by pneumatic, hydraulic or drop-weight hammers. The pneumatic hammers are operated by a pneumatically driven piston hammer with a sharp-pointed impact tool to effect pavement failure. In operation, such pneumatic hammers generate repetitive noise of high intensity from exhaust of compressed air and metal to metal, as well as metal to pavement impacts. The pneumatic hammer generates shocks and vibrations both to the operator and underground structures which are frequently damaged thereby. The pneumatic hammer generates a substantial amount of dust and requires considerable labor. Some of the above objections are overcome by hydraulic hammers utilizing high pressure oil as the working fluid in a closed system, providing a substantially quieter operation. However, hyraulic hammers have considerably lower efficiency on a power output to power input basis and still have metal to metal to concrete impact noise and dust. Drop-weight hammers are not widely used for fracturing pavements since they are inefficient and cause high shocks and vibrations likely to damage nearby underground structures.

This invention relates to an apparatus and process for producing high velocity water jet pulse or successive jet pulses at high stagnation pressures. Such water jet pulses when impacted against pavements produce shock waves in the pavement materials, penetrate into the pavement to produce a deep hole and build hoop stresses in the hole high enough to produce radial fractures. The pulsed water jet system of this invention is suitable for fracturing and breaking target materials which are pervious and brittle, such as asphalt, concrete, minerals and rocks. Since water is used in effecting fractures, the transfer of energy is substantially more complete than in the conventional mechanical impact methods. The water jet method of fracturing is substantially quieter than the previously mentioned mechanical methods due to the absence of impact of solid objects and the necessity to exhaust air. The wetting action of the water jet renders the process a substantially dust-free operation. Additionally, there is no mechanical impact tool to wear out. The pulsed water jet method lends itself well to multiple feed and to automated operation, especially advantageous in operations such as trenching.

There are basically three present methods of generating pulsed liquid jets of high velocity: cumulation or shape-charge principle; impact extrusion; and pressure extrusion.

The cumulation method involves impacting a preshaped column of liquid or gel with a high velocity piston and the expulsion of a slug of liquid or gel at high velocity due to the concentration or focusing of forces caused by the shape of the liquid or gel. Using preshaped gel in the form of hollow cylinders, the cumulation method is capable of producing high velocity slugs of very high (in excess of 200,000 psi) stagnation pressure capable of penetrating steel armor. The cumulation methods follow a principle similar to that of shaped-charge detonation of explosives except that stress waves rather than rapid combustion are involved in focusing of the forces. Practical equipment using the cumulation methods has not been developed due to difficulties in shaping the water and in obtaining a suitable feed system for rapidly repetitive operation.

The impact extrusion method involves impacting with a high velocity piston at one end of a cylinder, a column of water contained in a hollow cylinder and the subsequent expulsion of the water through a nozzle at the opposite end of the cylinder. The high velocity piston is powered by compressed air or gas or high pressure water or hydraulic oil and is allowed to accelerate gaining kinetic energy prior to impacting the water column. A wide variety of cylinders and nozzles have been developed to aid in the transfer of kinetic energy from the piston and to generate the high velocity water jets. Various designs of reciprocating mechanisms have been devised for cocking the impact piston to obtain high frequency repeat firing. Several "water cannons" have been constructed on the impact extrusion principle for breaking coal and rocks. Exemplary of such "water cannons" are those described in Chermensky et al., U.S. Pat. No. 3,601,987; Voitsekhovsky et al., U.S. Pat. No. 3,412,554; and W. C. Cooley, U.S. Pat. Nos. 3,521,820, 3,520,477 and 3,490,696. The previous "water cannons" cannot be used with good efficiency in vertical positions due to difficulties associated with maintaining a full column of water in the chamber prior to impact by the piston due to the relatively large nozzle orifice required. A suitable water feed system has not yet been developed for utilizing the prior art "water cannons" vertically, as is necessary for pavement breaking. Additionally, in the impact extrusion methods, the fracture of concrete or rock is produced by shock waves generated in the material during the initial water jet impact and this method cannot produce hoop stresses in the materials which are necessary to initiate long fractures.

The pressure extrusion methods are similar to the impact extrusion methods except that a power piston is used to pressurize a column of water instead of impacting it to produce a water jet through a nozzle. The transfer of force to the water in the pressure extrusion method is smoother than in the impact extrusion method and the pressure pulse produced is flatter and more rectangular in shape in contrast to the triangular pulse produced by the impact extrusion processes.

The present invention relates to a pulsed water jet apparatus and process operating on the principle of pressure extrusion to generate repetitive water jet pulses of high velocity and at high repetitive frequency.

A review of the state of the art in water jet cutting technology is set forth in the "Proceedings of the First International Symposium on Jet Cutting Technology" held Apr. 4–7, 1972, Cambridge University, United Kingdom, published by BHRA Fluid Engineering, Cranfield, Bedford, United Kingdom. These proceedings contain teachings of continuous water jet cutting in the article "Application of Water Jet Cutting Technology to Cement Grouts and Concrete" by L. H. McCurrick and R. D. Browne.

It is an object of this invention to provide a pulsed water jet apparatus which may be operated in a vertical, horizontal, or angled position.

It is still another object of this invention to produce a pulsed water jet apparatus having a water pulse of relatively long flat shape, approaching the energy output shape from the thrust generator.

It is yet another object of this invention to provide a water jet apparatus which keeps the water extrusion chamber full of water and thereby reduces the amount of air in the water.

It is still another object of this invention to provide a pulsed water jet apparatus which may be easily maintained in field operation.

A still further object of this invention is to provide an improved process for fracturing, breaking and removing a strip of pavement with minimal noise and dust pollution.

Other objects and advantages of the invention will become apparent from the following description taken in conjunction with the accompanying drawings showing preferred embodiments wherein.

Figure 1:
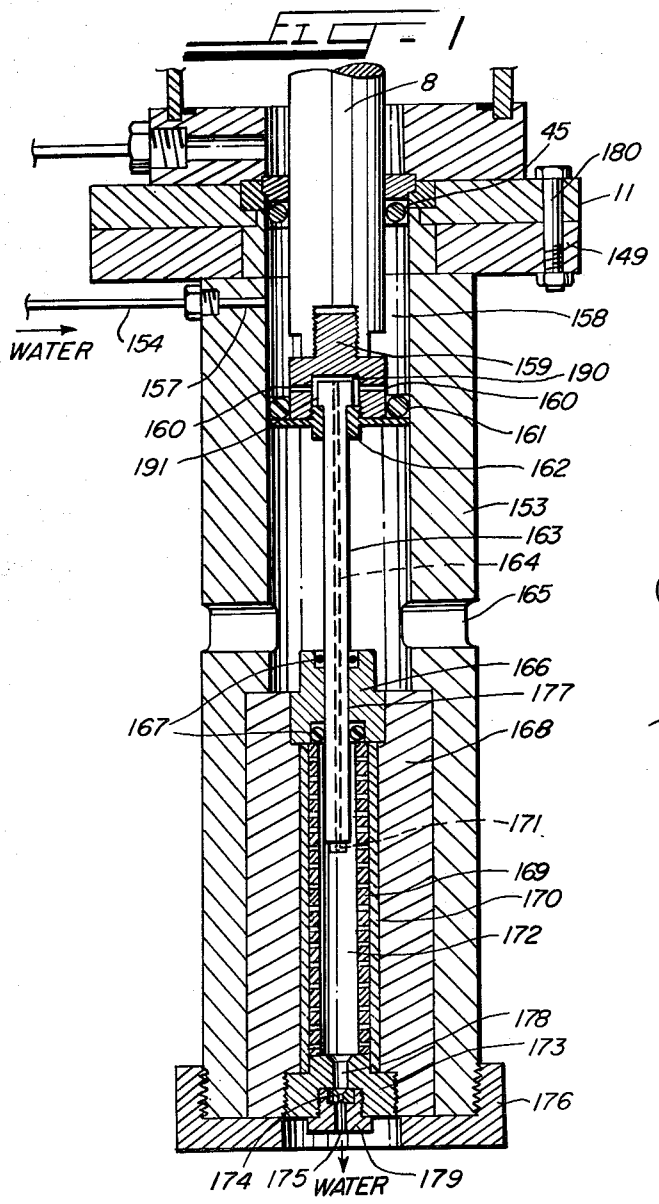
FIG. 1 is a partially sectioned view of one embodiment of a pulsed water jet intensifier of this invention.

FIG. 1 shows the output from a suitable thrust generator transmitted by the lower end of power piston rod 8 extending into protective cylinder 153. The end of power piston rod 8 engages water ram 163 through coupler 159 to transmit the thrust from the thrust generator to ram 163 for pressurizing water in high pressure chamber 172. Coupler 159 is fastened to the end of power piston rod 8 by any suitable means, such as being screwed into a threaded cavity in power piston rod 8. It is preferred that power piston rod 8 have a hollow construction to reduce its inertia.

Protective cylinder 153 comprises end cap 176 at one end and mounting plate 149 at the other end adjacent thrust generator and mounting plate 11.

The upper end of ram 163 is in communication with coupler 159 and is secured in place by retainer 162. Ram head 191 is a loose fit in coupler 159 permitting the upper end of ram 163 slight movement to allow alignment during the reciprocating movement of ram 163. Coupler 159 has water holes 160 to allow water to enter chamber 190 between flanged ram head 191 and coupler 159. Seal 161 surrounds coupler 159 to form a substantially watertight annular low pressure water precharging chamber 158 between piston rod 8 and the interior wall of low pressure cylinder 153. The upper boundary of water precharging chamber 158 is maintained substantially watertight by sealing means 45 in the lower mounting plate of the thrust generator. The volume of water precharging chamber 158 varies cyclically according to the movement of power piston rod 8. Ram 163 has passage 164 extending the length of ram 163 allowing water to pass from the upper end of ram 163 through the length of ram 163 through check valve 171 into high pressure chamber 172. The lower end of ram 163 always extends below high pressure upper cylinder plug 166 through hole 177 with seals 167 maintaining substantially watertight relation between high pressure chamber 172 and the volume within low pressure cylinder 153 above it. High pressure chamber 172 is bounded by perforated sleeve liner 169 within cylinder liner 170 which is within high pressure cylinder wall 168, high pressure upper cylinder plug 166 and high pressure lower cylinder plug 173. Ram 163 is adapted for reciprocating movement through upper cylinder plug 177 in substantially watertight relation maintained by seals 167.

High pressure cylinder liner 170 is a suitable corrosion resistant material, preferably stainless steel to protect the surface of high pressure cylinder 168 from water corrosion. Perforated sleeve liner 169 is a perforated stainless steel cylinder to aid in distribution of the water pressure around the entire internal surface of high pressure cylinder 168 during the power stroke. Cylinder liner 170 and sleeve liner 169 are held in place by high pressure upper cylinder plug 166 and high pressure lower cylinder plug 173. High pressure lower cylinder plug 173 has water passage 178 in its central portion and engages at its lower end nozzle plate 174. Nozzle plate 174 has central orifice 175 and is held in position by retainer plug 179 removably attached to lower cylinder plug 173. Retainer plug 179 is readily accessible from the outside to facilitate changing of nozzle plate 174. Nozzle plate 174 is made of sapphire, tungsten carbide or hardened steel and has a suitable orifice size and shape to provide a water jet of the desired characteristics. We have found that orifices of about 0.04 to about 0.1 inch diameter are suitable. The orifice does permit some water to drip out in the vertical position but is much smaller than the orifice necessary in the prior impact extrusion "water cannons". Further, the water which does drip out is replaced by a continuous water feed to the high pressure cylinder, thereby preventing undesired air entrapment in the water.

Figure 2:
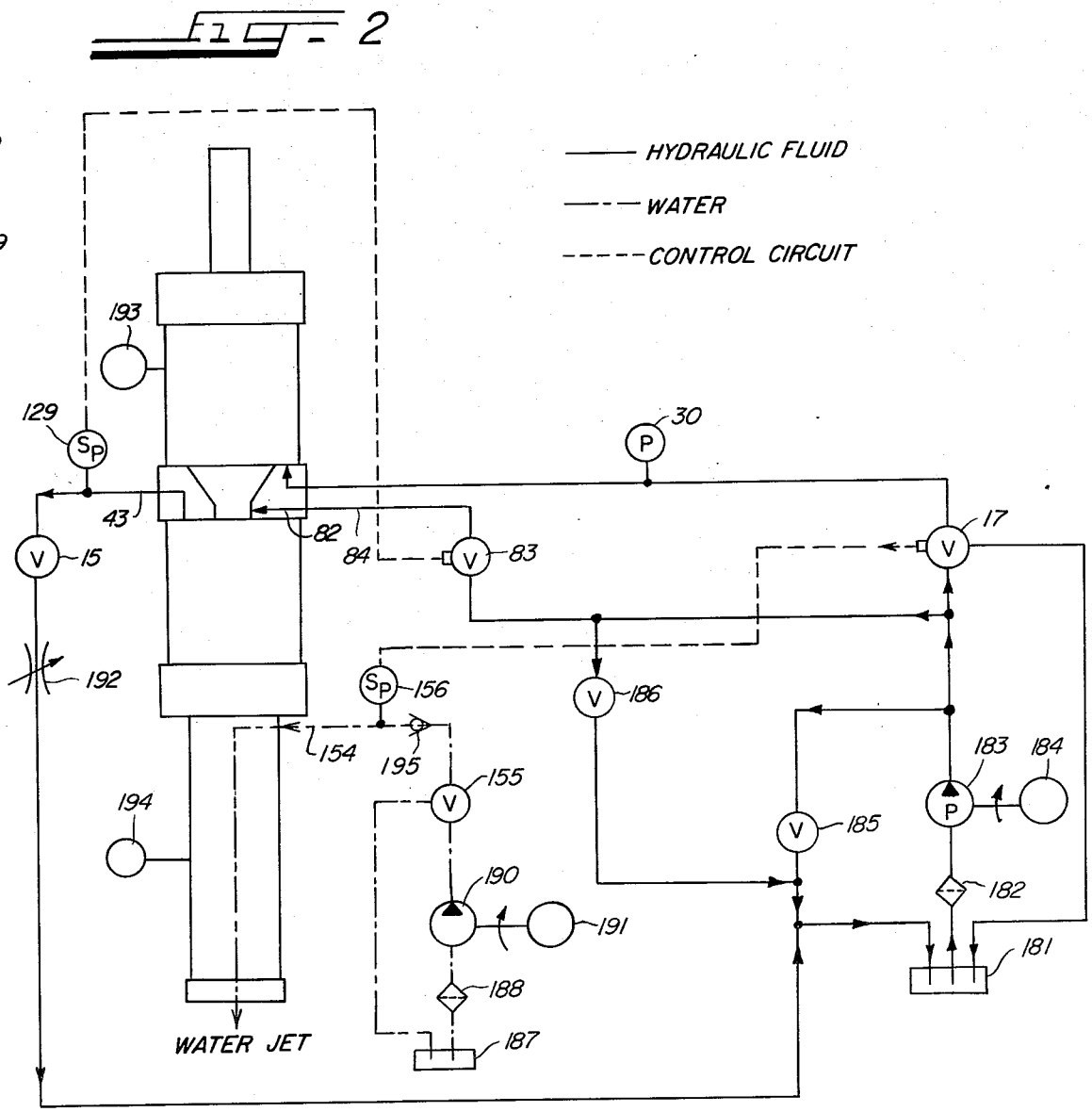
FIG. 2 is a schematic drawing of one embodiment of a suitable hydraulic and control system for the pulsed water jet intensifier of this invention.
Figure 5:
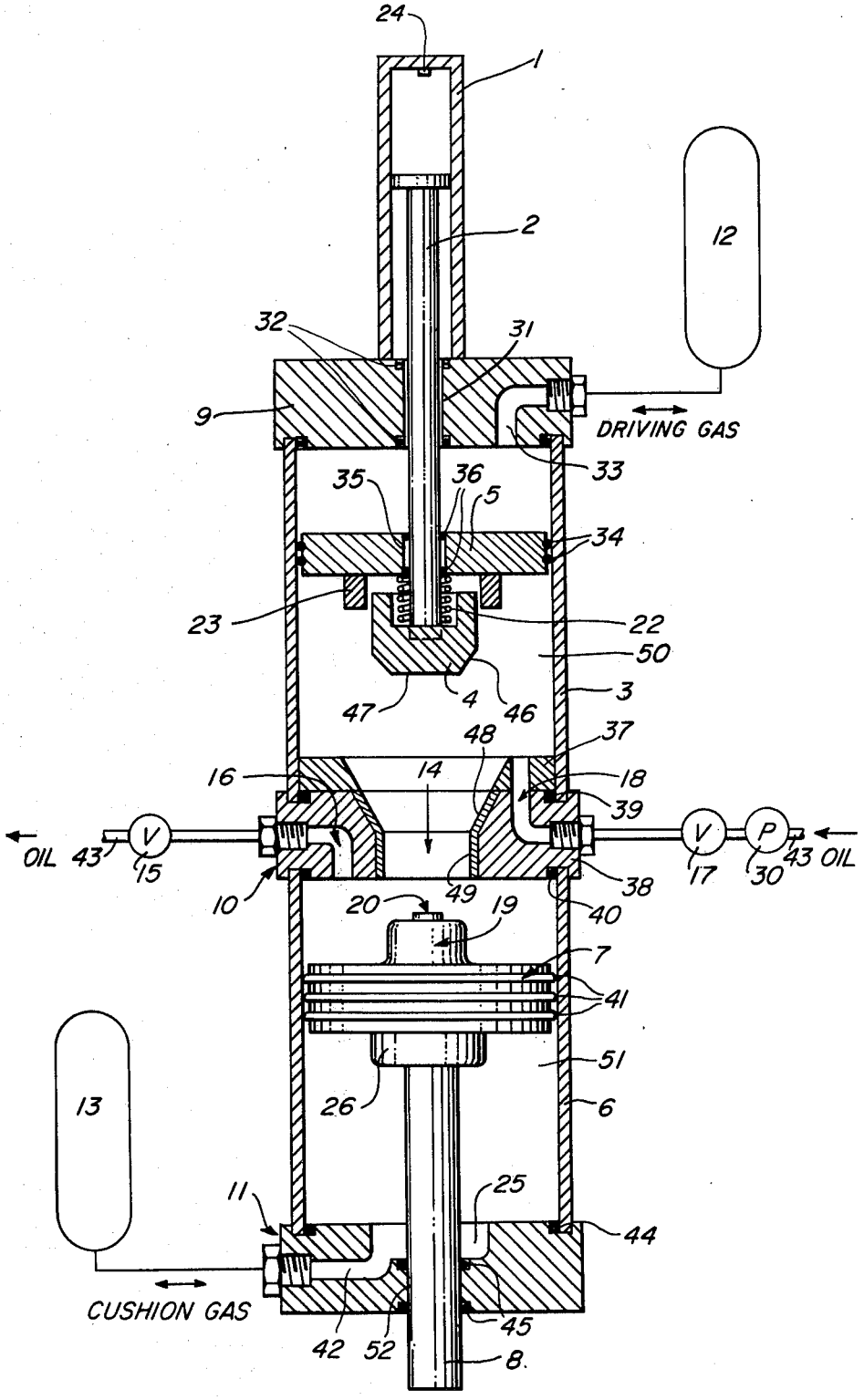
FIG. 5 is a partially sectioned view of a hydraulic-pneumatic thrust generator for powering the water jet of this invention.
Figure 6:
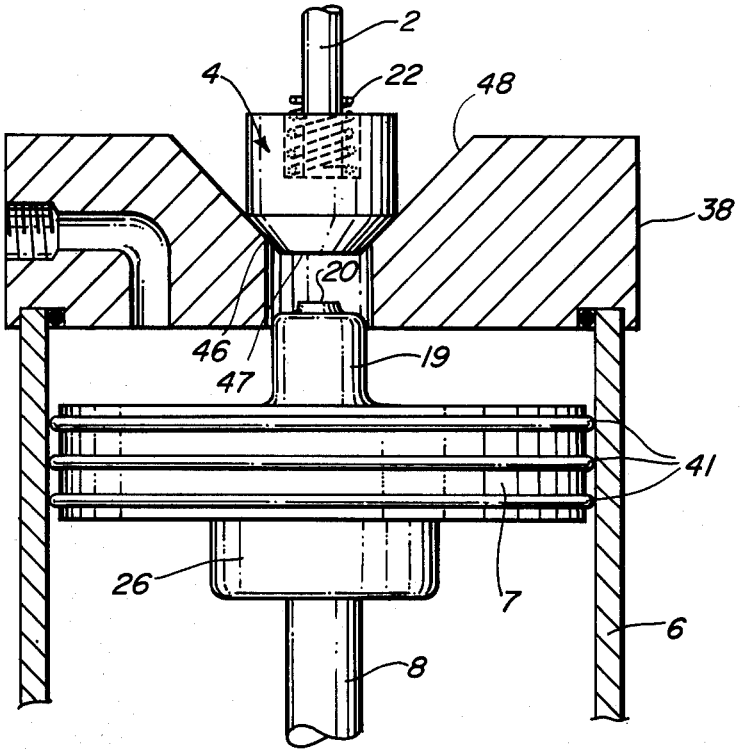
FIG. 6 is a partially sectioned detailed view of the valve actuator and check valve of the thrust generator shown in FIG. 5.

The water jet of this invention may be powered by any suitable thrust generator which provides a thrust stroke pattern in which the maximum thrust is reached shortly after actuation and the thrust level remains quite flat until near the end of the stroke. One especially suitable thrust generator for use to apply thrust to the water jet apparatus of this invention is the thrust generator described in allowed patent application Ser. No. 621,687, filed Oct. 14, 1975, Udo H. Mohaupt, now U.S. Pat. No. 3,999,384 together with improvements thereon as described in United States patent application Ser. No. 737,717, filed on even date with this application. The disclosures of said applications are incorporated herein by reference. Where applicable, the numbers in the figures of this application correspond to the numbers in the figures of said application Ser. No. 621,687, now U.S. Pat. No. 3,999,384. The descriptions, particularly with respect to FIGS. 1 and 2, are made utilizing the thrust generator of said applications, as shown in FIGS. 5 and 6 of this application as the power source for the water jet apparatus and process of this invention.

The high pressure water jet is generated by compression of water inside high pressure chamber 172 by the thrust of ram 163. The thrust of ram 163 is derived from power piston rod 8 of the thrust generator which is attached at its other end to power piston 7. The thrust is generated by expansion of compressed gas such as air or nitrogen stored in driving gas accumulator means 12. The force generated by the expansion of the compressed driving gas is transmitted to power piston 7 by use of a hydraulic working fluid contained in the portion of the driving cylinder 50 and cocking cylinder 51 between floating piston 5 and power piston 7. The hydraulic fluid leaves this volume through hydraulic fluid drain port 16 and is controlled by hydraulic fluid drain valve 15 which is in communication through conduit 43 with a hydraulic fluid reservoir. The hydraulic fluid enters this volume through hydraulic fluid supply port 18 controlled by hydraulic fluid supply valve 17 which is in communication with hydraulic pump 30. During automatic cycle operation of the water jet intensifier, hydraulic fluid supply valve 17 and hydraulic fluid drain valve 15 may remain open. When it is desired to operate the water jet intensifier at manual operating cycling rates, the hydraulic fluid supply and drain valves may be opened and closed with each cycle.

Water enters high pressure chamber 172 through a series of passages. Water inlet 157 at the upper end of protective cylinder 153 is in communication with water supply valve 155, pressure sensor 156, check valve 195 through conduit 154 as shown in FIG. 2. The water jet system can be operated only when a pressure of prescribed level is registered by pressure sensor 156, thus, avoiding firing of the water jet when there is no water in high pressure chamber 172. At the end of the power stroke, power piston rod 8 is at its lowest position and the annular precharging chamber 158 is at its largest volume. Water enters precharging chamber 158 through water inlet conduit 154 and fills its full volume. As power piston 7 of the thrust generator is being cocked, piston rod 8 moves upward causing the water in precharging chamber 158 to be forced into high pressure chamber 172 through water holes 160 in coupler 159 to chamber 190 and into ram passage 164 and through check valve 171. During the power stroke ram 163 moves downward with check valve 171 closed pressurizing the water in high pressure chamber 172 and forcing it to pass through nozzle 175 to produce the desired water jet.

At the end of the power stroke, both power piston 7 and floating piston 5 are at their lowest position and driving port 14 is closed by poppet valve 4 while high pressure chamber 172 is occupied by ram 163 and annular volume 158 is again filled with water. Hydraulic fluid drain valve 15 is open and hydraulic fluid is drained from the internal volume as the compressed cushion gas from the cushion gas accumulator pushes power piston 7 upward. Power piston 7 rises and since hydraulic fluid supply valve 17 is open, the high pressure hydraulic fluid enters driving cylinder 50 pushing floating piston 5 upward, thereby restoring the driving gas pressure in driving gas accumulator means 12. During entry of the high pressure hydraulic fluid to driving cylinder 50, poppet valve 4 is seated within the driving port thereby isolating the driving cylinder from the cocking cylinder. As power piston 7 moves upward, water occupying annular precharging chamber 158 is compressed and forced into high pressure water chamber 172. As driving cylinder 50 is being filled with high pressure hydraulic fluid, the low pressure hydraulic fluid in cocking cylinder 51 is being drained and high pressure water cylinder 172 is being filled with water and power piston 7 is moving upward. Poppet actuator 19 dislodges poppet valve 4 from its seated position in driving port 14 sending it rapidly upward. To obtain the highest possible water jet pressure, it is advantageous to maintain the cushion gas pressure as low as possible. A hydraulic triggering system may be used to aid the poppet actuator in dislodging the poppet valve. This is shown in FIG. 2 by use of bleed port 82 having an opening between poppet end 47 and poppet actuator 19 when they are in their contact positions. Hydraulic fluid injection valve 83 controls the flow of pressurized hydraulic fluid from conduit 84 through bleed port 82 to increase the pressure against the bottom of poppet valve 4. As low pressure hydraulic fluid is drained from the thrust generator, a back pressure can be measured in the hydraulic fluid drain conduit until all of the hydraulic fluid is drained out and the power piston 7 reaches its uppermost position. Pressure sensor 129 in hydraulic fluid drain conduit 43 can be used to monitor the position of the power piston 7 and to open hydraulic fluid injection valve 83 to inject a volume of high pressure hydraulic fluid against the bottom of poppet valve 4 thereby reducing the difference in pressure between the top and bottom of poppet valve 4. When dislodged, the poppet valve moves rapidly upward to its uppermost position and high pressure hydraulic fluid from driving cylinder 50 rushes through port 14. The initial downward movement of power piston 7 is sufficiently slow to allow poppet valve 4 to reach its uppermost position. After poppet actuator 19 clears the driving port, the high pressure hydraulic fluid exerts pressure to the entire upper surface of power piston 7 and power piston 7 quickly accelerates to a relatively constant downward rate. The force is transmitted by power piston rod 8 to ram 163 to pressurize water in high pressure chamber 172 and to eject water out of nozzle orifice 175 in the form of a high velocity water jet. At the end of the power stroke, poppet valve 4 seats itself in driving port 14 thereby cutting off the driving force of the high pressure hydraulic fluid. Power piston 7 will be stopped by the increased pressure of cushion gas at the bottom of power cylinder 51 and by water remaining in high pressure chamber 172. Thus, the back pressure of water remaining in high pressure chamber 172 acts as a benefit in reducing the necessary pressure of the cushion gas in the thrust generator. This further benefits the thrust generator operation by utilization of the hydraulic triggering mechanism for dislodgment of poppet valve 4 as described above.

FIG. 2 shows one preferred embodiment of combination of the water jet of this invention with the thrust generator described in the above identified patent applications. The high pressure hydraulic fluid is supplied from reservoir 181 by hydraulic pump 183 of suitable pressure rating and capacity. Pump 183 can be driven by any suitable power means 184 such as a gasoline engine or electric motor. The hydraulic fluid is preferably pumped from reservoir 181 through filter 182 to assure fluid free from particular contaminates. Pressure relief valve 185 is desired to prevent over-pressurization of the hydraulic fluid. The supply of high pressure hydraulic fluid to the thrust generator is controlled by valve 17 which also has a bypass to permit the pressurized hydraulic fluid to return to reservoir 181 when valve 17 is closed. Valve 186 is desired to assure adequate return of high pressure hydraulic fluid to reservoir 181 to allow use of a constant volume hydraulic pump and to avoid heat generation in valve 17. The operation of valve 17 is controlled by pressure sensor 156 in the water supply line to assure that water supply valve 155 is opened prior to the opening of high pressure hydraulic fluid control valve 17. Water is supplied to the water jet intensifier from reservoir 187 by pump 190 driven by power means 191, suitably an electric motor, through filter 188 to prevent particulate contamination of the water and possible interference in nozzle orifice 175. The flow of water to the water jet intensifier is controlled by control valve 155 which has a bypass allowing water to return to reservoir 187 when control valve 155 is closed and a check valve 195 which allows water to be pressurized in precharging chamber 158 of the intensifier. Another suitable water supply system would be the use of compressed air or gas to maintain suitable supply pressure thereby eliminating te need for pump 190 and power means 191.

Hydraulic fluid drain line 43 has pressure sensor 129, control valve 15 and throttle valve 192. pressure sensor 129 senses the back pressure in drain line 43 and controls the opening and closing of hydraulic fluid injection valve 183 to trigger dislodgment of the poppet valve from the poppet valve seat. Throttle valve 192 controls the rate at which the low pressure hydraulic fluid is drained to reservoir 181, thereby providing adjustment to the back pressure in drain line 43.

Strain gauges 193 and 194 may be utilized to monitor the stresses built up in the thrust generator driving cylinder and in the high pressure water cylinder, respectively.

Operation of the pulsed water jet apparatus can be either continuous or intermittent. At the end of the power stroke, the thrust generator may be stopped by maintaining both the hydraulic fluid drain and the hydraulic fluid supply valves in a closed position. To commence operation of the cycle requires only the opening of the hydraulic fluid supply and drain valves. The operation of these valves can be controlled manually or automatically as desired, in conjunction with a suitable programmable controller. To sustain continued operation, the hydraulic fluid drain valve will remain open and the thrust generator, together with the water jet intensifier, will recycle at a reciprocating rate determined by the supply rate of high pressure hydraulic fluid, the operating pressure, the stroke length and the clearance of the poppet actuator in the driving port. The reciprocating rate is more fully explained in Example I of said parent applicaton, Ser. No. 621,687, now U.S. Pat. No. 3,999,384 wherein it was pointed out that with the thrust generator geometry and dimensions set forth in that Example I, a reciprocating rate of 6 cycles per minute was obtained with a hydraulic pump capacity of 21 gals. per minute while increasing the pump capacity to 113 gals. per minute increased the reciprocating rate to 30 cycles per minute. The output pressure of the water jet intensifier is largely dependent upon the pressure of the driving gas of the thrust generator which can be readily adjusted to suit the strength of materials to be fractured. The amount of water per pulse is determined by the bore of the high pressure water chamber and by the stroke length of the water ram which is, in turn, determined by the stroke length of the thrust generator. In practice, the amount of water per pulse is fixed by the design of the high pressure water jet apparatus and cannot be readily altered. For fracture of pavement of the nature commonly encountered in city streets, the amount of water per pulse should be greater than 20 cubic inches.

Additives may be incorporated into the water used in the pulsed water jet system of this invention. Antifreeze can be added to prevent icing and freezing of the water during winter operations. Emulsifiable oil can be added to improve lubrication properties of the water. Long chain polymers such as polyethylene oxide can be added to the water to render the water jet more coherent to improve its penetration into the material to be fractured.

The pulsed water jet system of this invention is particularly suited for automated trenching operations. Presently, trenches for installing pipe, cable or other underground conduits are made by a slow process involving many pieces of equipment. Typically, concrete saws are employed to make perimeter cuts to desired width of the trench and subsequently pneumatic hammers are used to fracture the pavement between the perimeter cuts. After that, a backhoe or other shovel is required to remove the fractured pavement and to dig the trench. Using the apparatus and process of this invention, it is convenient to combine the high-pressure pulsed water jet apparatus with the other hydraulic and mechanical apparatus on a single moveable base to provide an improved method of pavement removal which is more efficient, quieter, faster and less expensive than methods currently available. The pulsed water jet of this invention may be combined with a perimeter cutting method which may be either a continuous water jet cutting system or two concrete saws and mechanical means of removing fractured pavement, a central hydraulic power pack supplying the necessary power to operate all of these systems.

Figure 3:
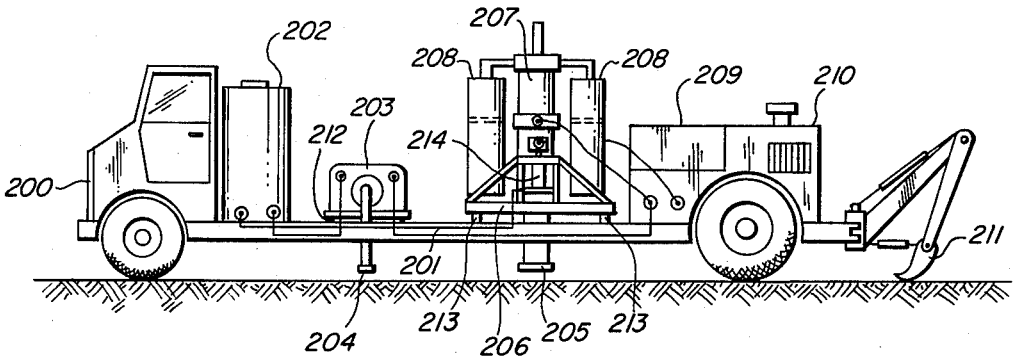
FIG. 3 is a side view of one embodiment of a truck-mounted apparatus for fracturing, breaking and removing a strip of pavement in accordance with the process of this invention.

Referring to FIG. 3, motor vehicle 200 is shown having mounted on it all of the equipment necessary for pavement fracturing and trenching according to this invention. Hydraulic power pack 209 is powered by gasoline or diesel engine 210. A pulsed water jet intensifier as described above is shown as 207 with associated gas accumulators 208 and water jet nozzle 205. Continuous water jet intensifier 203 is shown with two perimeter cutting nozzle assemblies 204. A water supply tank is shown as 202 and hydraulically operated backhoe is shown as 211. Hydraulic power pack 209 supplies the high pressure hydraulic fluid for operating the thrust generator in connection with the pulsed jet intensifier 207, continuous jet intensifier 203 and backhoe 211. Pulsed jet intensifier 207 is mounted on suitable framework 206 which can move transversely to the axis of the vehicle on rails 213 while rails 213 can move along the axis of the vehicle on chassis 201. Pulsed jet intensifier 207 can also be raised or lowered by means of hydraulic cylinders 214 thus providing the pulsed jet intensifier 207 with X-Y-Z mobility by means of hydraulic power so that nozzle 205 can be positioned at each successive desired location by a programmable hydraulic control system. Continuous jet intensifier 203 is mounted on base 212 which also can be moved along the truck chassis 201. The continuous jet nozzle assemblies 204 are also adjustable with respect to height from the pavement and spacing between them. Water tank 202 supplies water for both the pulsed jet intensifier 207 and continuous jet intensifier 203.

In operation, vehicle 200 moves in increments essentially governed by the time required for the continuous water jet system to cut the trench perimeter, determined by the thickness and strength characteristics of the pavement. The pulsed water jet intensifier is placed at a suitable height to provide suitable nozzle standoff distance and its X-Y transversing mechanism programmed for the intensifier to move back and forth across the width of the trench firing intermittently at desired intervals. This results in a strip of pavement having many holes desirably linked by fractures which may be lifted by a hydraulic backhoe or other shovel mechanism to remove the fractured pavement and provide a desired trench.

Figure 4:
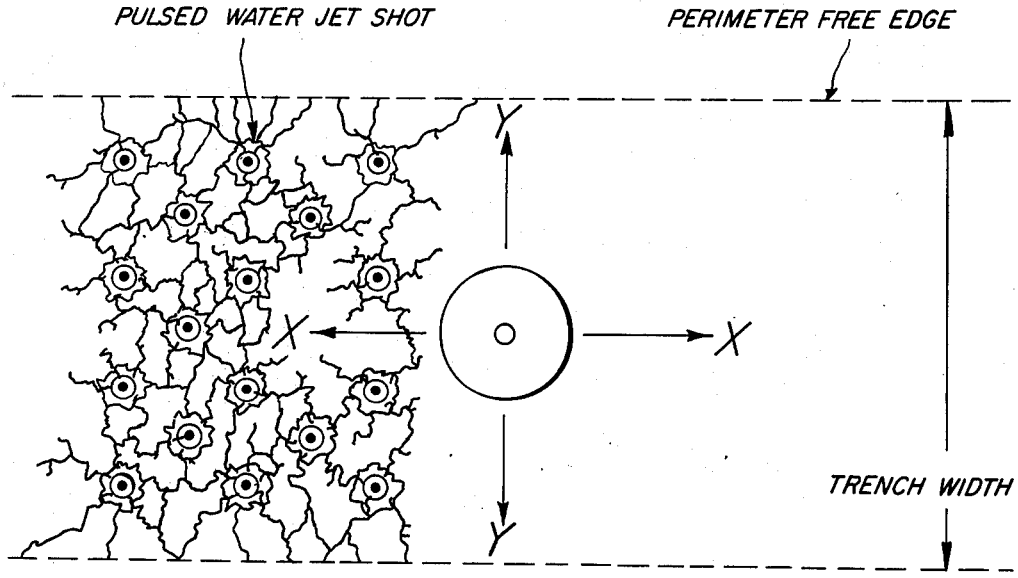
FIG. 4 is a schematic drawing showing how the water jet pulses could be applied in fracturing a strip of pavement according to this invention.

FIG. 4 shows a suitable firing pattern of the pulsed water jet intensifier of this invention. It is desired to first make the trench perimeter cuts providing free edges at the trench perimeters. In some cases, of course, the free edges may be provided by already existing free edges. For fracturing high strength concrete, the pulsed water jet shots should be spaced not more than 6 inches apart and not more than 6 inches from existing free edges to obtain connecting cracks. The first pulsed water jet shot should be sufficiently close to a free edge to obtain stresses and fractures extending to the free edge and successive jet pulses sufficiently close to each other to obtain fractures extending to the zone of adjacent jet pulse centers. Due to the relatively long, flat water jet force pattern according to this invention, a hole is first made in the hard material at the jet pulse center and due to continued jet force the adjacent hard material, such as concrete, is pressurized and fractured due to hoop stresses in the hard material. The flat water jet pulse force shape of the process of this invention and the manner of fracturing pavement by hoop stresses according to this invention, may be contrasted to the triangular force shape of the pavement fracturing method of U.S. Pat. No. 3,614,163 wherein impact stresses and shock waves dependent upon reflection from free edges fracturing the pavement. The process of the present invention is not dependent upon such wave pulse reflection, but can utilize a greater portion of the pulse energy toward desired pavement fracture. The firing pattern is predetermined by the characteristics of the pavement. The characteristics of the pavement also determine other operating parameters of both the continuous and pulsed water jet systems including the water jet pressure nozzle diameter and nozzle standoff distance. Generally, for concrete, the nozzle standoff distance should be maintained at less than 1 inch. Greater standoff distances may be used for weaker or thin concrete or asphalt. Standoff distance of less than 0.5 inch is preferred for high strength concrete. At greater standoff distances, the concrete frequently exhibits spalling rather than fracturing. Tests have shown that satisfactory fracture of concrete slabs occurred when the water jet penetration into the slab was greater than 50% of the slab thickness and the distance between pulse centers or pulse centers and a free edge was less than 10 inches. When a free edge is not available, repeated water jet pulses in a small area will break the concrete and provide free edges for subsequent pulses. It is seen from FIG. 4 the apparatus and process of this invention works best when the pulsed water jets are centered sufficiently close so as to produce fractures linking the compression zones of adjacent water jet holes. Since concrete and asphalt pavement are basically non-homogeneous materials due to aggregates and reinforcing rods, the results of an individual shot of the pulsed water jet may vary depending upon whether it hits hard materials within the pavement. Therefore, to break a large piece of pavement with a single shot of a pulsed water jet requires that the shot be made at a strategic location and thus, defeats the fast cyclic feature of the apparatus by requiring slow cycle operation and a skilled operator.

Utilizing the pulsed water jet apparatus of this invention as described above, the pavement fracturing and removal process becomes essentially automatic requiring the operator only to move the vehicle along the desired course and removal of the fractured pavement and dirt from the trench.

When thick reinforced concrete is encountered, it is preferred to use concrete saws for cutting the perimeter of the trench since the continuous water jet may be inadequate or too slow to effect cuts of sufficient depth. The concrete saws may be lubricated with water from the water system supplied on the truck. When heavy reinforcing rod is used in the pavement, it is frequently necessary to use a cutting torch to cut the reinforcing rods after their exposure by fracture of the pavement in order to obtain pieces of pavement of a size which can be loaded into a truck.

EXAMPLE I

A pulsed water jet intensifier was constructed as shown in FIG. 1 and utilized the thrust generator described in said allowed patent application Ser. No. 621,687 and having the following dimensions and volumes. The thrust generator had a stroke length of 10 inches and generated a maximum thrust of about 200,000 lbs. The piston rod of the thrust generator had a diameter of 4.5 inches and was connected to a ram having a diameter of 1⅝ inches. The diameter of the power piston of the thrust generator was 10 inches; thus the thrust generator-ram combination had a pressure intensification factor of 38. The total volume of the high pressure water chamber was 20 cu. inches and the stroke length of the ram was 10 inches. When the thrust generator was operated at maximum thrust, the pulse water jet intensifier would theoretically attain a maximum water pressure of about 100,000 psig with a nozzle of 0.08 inch in diameter. The apparatus used in this example obtained a maximum water pressure of 70,000 psig with a 0.08 inch diameter nozzle and 90,000 psig with a 0.04 inch diameter nozzle due principally to loss in thrust caused by friction of seals and inertia of power drive train. The nozzle used in this apparatus was constructed of sapphire and had a cone-shaped orifice. When the apparatus was operated at peak water pressure with a 0.08 inch nozzle, each water jet pulse had a duration of about 0.1 seconds, indicating an average water jet velocity of slight greater than 3300 feet per second. When the thrust generator was connected to a hydraulic pump of 21.7 gals. per minute capacity and to a control system shown in FIG. 2, a cycling rate of about 6 cycles per minute was achieved. In such maximum-pressure operations, the pressure of the thrust generator driving hydraulic fluid was set at 2500 psig and a cocking pressure of 600 psig was required to actuate the poppet valve of the thrust generator. Using the hyraulic triggering mechanism disclosed in U.S. patent application Ser. No. 737,717, THRUST GENERATOR, Udo H. Mohaupt, filed concurrently herewith, the cocking pressure required to actuate the poppet valve was reduced to about 300 psig and the maximum water pressure with a 0.08 inch nozzle was raised up to about 80,000 psig.

EXAMPLE II

The apparatus of Example I was used to fracture concrete slabs of various types and sizes. Cast concrete slabs of 5700 psi compressive strength of various sizes have been fractured with the pulsed water jet. Small slabs of 5 inches × 5 inches × 6 inches were fractured with one center shot at 50,000 psig water jet pressure. Larger slabs of 16 inches × 16 inches × 6 inches were fractured with a center shot at 70,000 psig water jet pressure, but occasionally more than one shot has been required to effect fracture due to a hard aggregate, such as quartz or granite, being in the path of the water jet, thus reducing the effective jet penetration. When more than one shot was applied to the larger concrete slabs and effected fracture of the slab, the fracture pattern indicated that each shot made on the slab produced radial fissures and significantly weakened the slab, subsequent shot thus linked the fractures and caused the slab to disintegrate.

When the pulsed water jet was applied to concrete of lower strength, such as the air-entramped type for greater freeze-thaw resistance (the type used extensively on bridge decks), the water jet pressure required to break the concrete was considerably lower than that for high strength concrete. Air-entramped concrete slabs of 5 inches × 5 inches × 6 inches were fractured with one center shot of water jet pressure of less than 40,000 psig. Asphalt slabs were also fractured at comparable water jet pressures.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A high pressure pulsed water jet apparatus operable in a vertical, horizontal or angled position comprising:

a cylindrical high pressure chamber having a nozzle in communication therewith at one end and a substantially watertight plug at the other end;

a cylindrical low pressure chamber having one end adjacent said other end of said high pressure chamber and the other end of said low pressure chamber adapted for receiving in substantially watertight relation one end of a power piston rod providing the output of a thrust generator means having a substantially flat thrust pattern;

a coupler piston coupled to said power piston rod adapted for substantially watertight reciprocal movement within said low pressure chamber;

a cylindrical ram coupled to said coupler piston and having a liquid passage therethrough along its long axis adapted to reciprocate within said high pressure chamber and through said plug in substantially watertight relation, a check valve preventing intake of water to said passage at one end maintained within said high pressure chamber, the other end of said liquid passage in communication with the volume between said coupler piston and said other end of said low pressure chamber; and pressure means for maintaining liquid in said other end of said low pressure chamber.

2. The apparatus of claim 1 wherein said high pressure cylinder has a cylinder liner of corrosion resistant material, a perforated core liner surrounding said cylinder liner.

3. The apparatus of claim 2 wherein said cylinder liner is stainless steel.

4. The apparatus of claim 2 wherein said core liner is perforated stainless steel.

5. The apparatus of claim 1 wherein said nozzle is retained in position by retainer means to the exterior of the apparatus.

6. The apparatus of claim 1 wherein said nozzle is constructed of material selected from the group consisting of sapphire, tungsten carbide and hardened steel.

7. The apparatus of claim 6 wherein said nozzle has an orifice of about 0.04 to 0.1 inch diameter.

8. A process for producing high pressure pulsed water jets comprising; introducing and maintaining liquid in an annular precharging chamber in the upper portion of a low pressure chamber, providing the reciprocating power stroke-cocking stroke output of a thrust generator means having substantially flat power stroke thrust pattern to a coupler piston adapted for substantially watertight reciprocal movement within said low pressure chamber whereby during the cocking stroke of said thrust generator the liquid passes under pressure from the annular precharging chamber through a liquid passage in the central portion of a cylindrical ram into a high pressure chamber and during the power stroke of said thrust generator said liquid is pressurized within said high pressure chamber and passes through a nozzle in the lower end of said high pressure chamber to produce the desired pulsed water jet, return of said liquid through said liquid passage during said power stroke being prevented by a check valve, and repeating said reciprocating cycle.

9. The process of claim 8 wherein the volume of said annular precharging chamber varies according to the movement of said piston rod of said thrust generator and the maximum volume of said annular precharging chamber is greater than the volume of said high pressure chamber.

10. The process of claim 8 wherein said nozzle has an orifice of about 0.04 to 0.1 inch diameter.

11. An apparatus for fracturing pavement comprising; a moveable vehicle, a water reservoir mounted upon said vehicle, a high pressure pulsed water jet apparatus mounted on said vehicle and having moving means for moving said water jet apparatus transversely to and along the axis of said vehicle and for moving said water jet apparatus toward or away from the pavement upon which said vehicle rides, said high pressure pulsed water jet apparatus comprising:

a cylindrical high pressure chamber having a nozzle in communication therewith at one end and a substantially watertight plug at the other end;

a cylindrical low pressure chamber having one end adjacent said other end of said high pressure chamber and the other end of said low pressure chamber adapted for receiving in substantially watertight relation one end of a power piston rod providing the output of a thrust generator means having a substantially flat thrust pattern;

a coupler piston coupled to said power piston rod adapted for substantially watertight reciprocal movement within said low pressure chamber;

a cylindrical ram coupled to said coupler piston and having a water passage therethrough along its long axis adapted to reciprocate within said high pressure chamber and through said plug in substantially watertight relation, a check valve preventing intake of water to said passage at one end maintained within said high pressure chamber, the other end of said water passage in communication with the volume between said coupler piston and said other end of said low pressure chamber; and pressure means for maintaining water in said other end of said low pressure chamber.

12. A process for pavement or rock fracture comprising striking said pavement or rock with pulses of a high pressure water jet wherein said high pressure pulsed water jet is produced by a process comprising introducing and maintaining liquid in an annular precharging chamber in the upper portion of a low pressure chamber, providing the reciprocating power stroke-cocking stroke output of a thrust generator means having substantially flat power stroke thrust pattern to a coupler piston adapted substantially watertight reciprocal movement within said low pressure chamber whereby during the cocking stroke of said thrust generator the liquid passes under pressure from the annular precharging chamber through a liquid passage in the central portion of a cylindrical ram into a high pressure chamber and during the power stroke of said thrust generator said liquid is pressurized within said high pressure chamber and passes through a nozzle in the lower end of said high pressure chamber to produce the desired pulsed water jet, return of said liquid through said liquid passage during said power stroke being prevented by a check valve, and repeating said reciprocating cycle.

* * * * *